United States Patent [19]

Dahlgren et al.

[11] 4,453,463

[45] Jun. 12, 1984

[54] INKING SYSTEMS

[76] Inventors: Harold P. Dahlgren, 11 Turtle Creek Bend, Dallas, Tex. 75204; James E. Taylor, 4129 Drowsy La., Dallas, Tex. 75233; John W. Gardiner, 2116 Oak Meadows Pl., Bedford, Tex. 76021

[21] Appl. No.: 371,803

[22] Filed: Apr. 26, 1982

Related U.S. Application Data

[63] Continuation-in-part of Ser. No. 282,294, Jul. 13, 1981.

[51] Int. Cl.[3] ..... B41F 7/26; B41F 7/36

[52] U.S. Cl. ..... 101/148; 101/350

[58] Field of Search ..... 101/363, 350, 365, 148, 101, 351, 352; 118/261, 262, 413; 15/256.51, 256.5

351, 352; 118/261, 262, 413; 15/256.51, 256.5

[56] References Cited

U.S. PATENT DOCUMENTS 3,230,928 1/1966 Stalmuke ..... 118/113
4,088,074 5/1978 Dahlgren ..... 101/350
4,127,067 11/1978 Dahlgren ..... 101/350
4,237,785 12/1980 Dahlgren ..... 101/148 X

FOREIGN PATENT DOCUMENTS 2812998 11/1978 Fed. Rep. of Germany ..... 101/363

*Primary Examiner*—J. Reed Fisher
*Attorney, Agent, or Firm*—Gerald G. Crutsinger; John F. Booth; Monty L. Ross

[57] ABSTRACT

An inker for a lithographic printing press in which ink and dampening fluid are applied to the printing plate by a resilient applicator roller. A resilient ink metering member having a flat metering surface is mounted on a support member which is movable to adjust the angle of intersection of the metering surface relative to a plane tangent to the roller surface. A doctor blade is mounted to remove dampening fluid from the roller surface and is actuated to an operative position upon actuation of the dampener to apply dampening fluid to the applicator roller.

17 Claims, 23 Drawing Figures

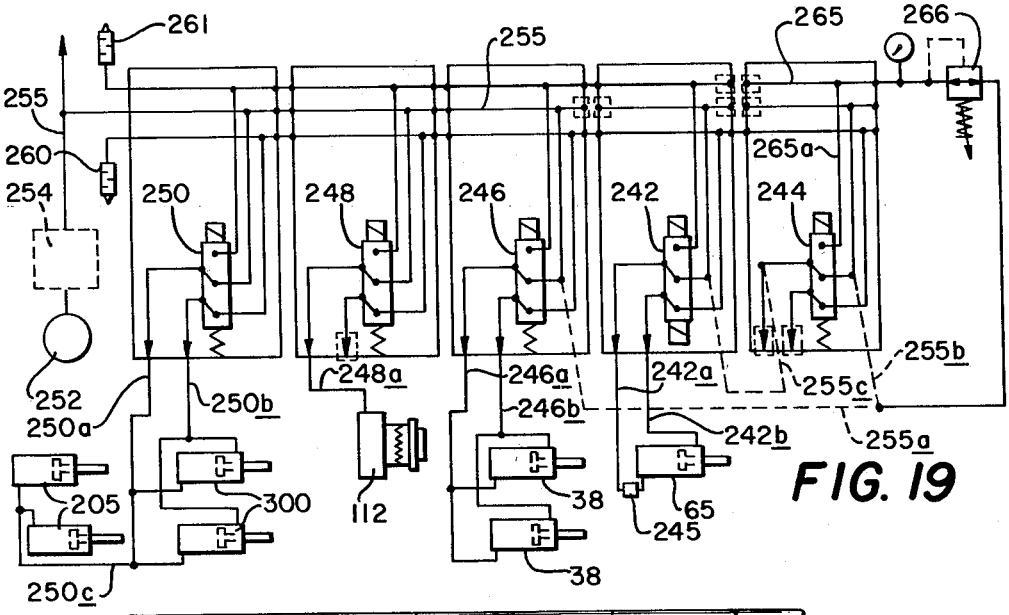
FIG. 19
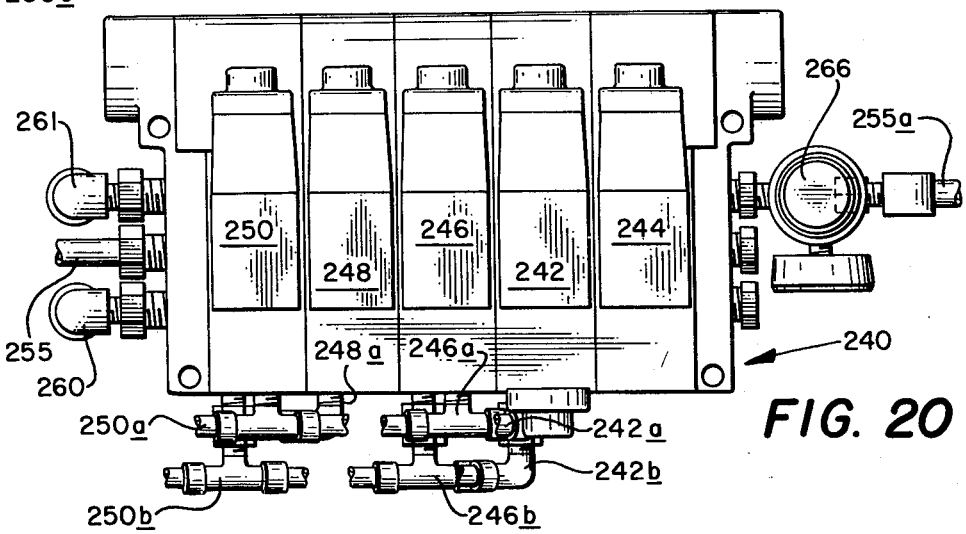
FIG. 20
FIG. 21
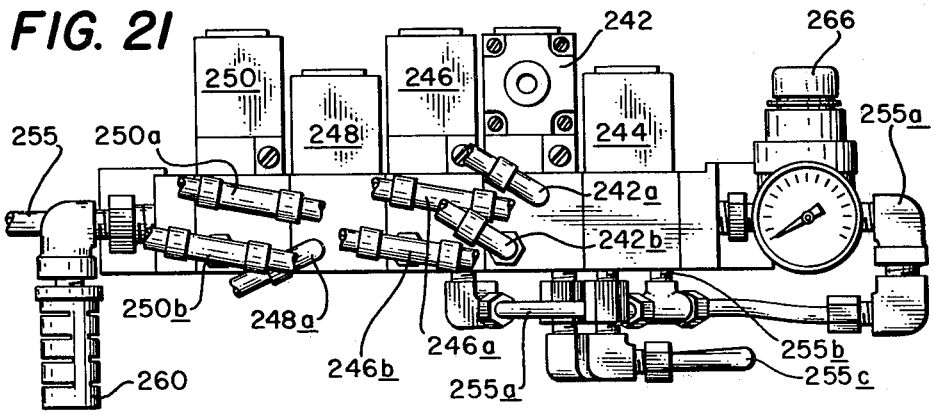

INKING SYSTEMS

CROSS REFERENCE TO RELATED APPLICATIONS

This application is a continuation-in-part of Ser. No. 282,294, filed Jul. 13, 1981, entitled "Ink Metering Apparatus With Obtuse Metering Member."

BACKGROUND OF INVENTION

All activities involved in the preparation of negatives, positives, half-tones, linework and solids in the preparation of metal plates is a photo-mechanical process. A metal printing plate is a photo contact print, exposed to light, developed and processed for the lithographic printing press.

No ghosting effect, influence, crossover influence, front-to-back color variation or across the sheet color variations are ever established by the making of a printing plate. Conventional printing presses equipped with conventional inkers introduce inherent ghosting effects and other inaccurate printing of the printing plate onto the printed sheet. It is the effect of a particular form or printed format with its ghosting potential, front and back influence, and crossover, which is transmitted to the conventional inking system and is continuously transmitted back and forth from the printing plate to the inking system and from the inking system back to the printing plate. This continues throughout the run, making color control very difficult and color variation the norm for conventional printing presses. Heretofore color variations have been established and perpetuated throughout a printing run by conventional inking systems.

Structural components of inking systems heretofore devised have been eliminated from the improved inking systems disclosed herein while providing a new structure capable of forming a smooth continuous film of ink on a resilient applicator roller surface for application to a printing plate to provide photo-mechanical reproduction of the printing plate onto a blanket cylinder and to the paper. No ink keys are employed and no job-to-job adjustments are necessary. To change from one job to another, one merely changes the printing plate. No inker adjustments are made to match the new job. Solids, half-tones, line work and process, all are printed at the same time and at the same ink setting. Gear streaks, hickeys, and improper water balance are problems which constantly plague printers using conventional inking systems.

The improved inking system disclosed herein offers a solution to the technical problem of providing an inking system which will faithfully reproduce an image on a printing plate by a photo-mechanical process while eliminating gear streaks, ghosting, and color variation resulting from the inability of the printing press to offer a fresh continuous uniform film on each revolution of the printing plate.

SUMMARY OF INVENTION

The improved inking system disclosed herein incorporates several improved features in structure mounted about a resilient surfaced applicator roller to form a continuous uniform film of ink so that every point on a printing plate is offered the same ink film upon every revolution of the plate to permit faithful photo-mechanical reproduction of the printing plate.

The improved structure includes an improved oscillator roller drive mechanism wherein a pair of ink smoothing rollers of substantially equal mass are urged in opposite directions by cam rollers on opposite ends of a rocker arm adjacent opposite sides of the inker. The smoothing rollers of approximately equal mass move in opposite directions and the kinetic energy which would normally be transmitted to the press drive train for decelerating a smoothing roller is transmitted to another smoothing roller moving in the opposite direction to minimize application of oscillatory loading into the printing press drive which could cause undesirable vibration of the structure. In addition, the oscillator roller drive mechanism is employed in combination with an applicator roller which is significantly larger and of greater mass than conventional inking form rollers. The applicator roller has significant mass and the oscillator roller drive is driven by a gear train on the drive shaft of the massive applicator roller such that any oscillatory loading resulting from movement of the vibrator rollers will be damped and its influence substantially eliminated by the inertia of the applicator roller.

An improved positive variable speed drive is provided for the applicator roller so that a precise speed relationship between the applicator roller and the printing plate can be established.

A set of improved metering members which are particularly adapted for forming a thin film of uniform thickness on an applicator roller, is provided and is adjustable by an improved blade holder assembly for establishing and maintaining a precisely controlled film of ink on an applicator roller surface. The improved holder for the metering members includes spring locking elements to facilitate replacement of one metering member with another for establishing different ranges of thickness of the film of ink formed on the applicator roller to permit use of a variety of inks of different viscosity. An improved end dam construction is employed in combination with the metering member and the metering member support to form a reservoir of ink on the applicator roller surface.

To prevent undesirable marking of the applicator roller when the press is stopped, an improved air circuit is employed for actuating the metering member to reduce pressure between the metering member and the applicator roller when the press is stopped. Night latches are provided on vibrator rollers and dampener rollers to permit reduction of pressure at the nip between the various rollers if the press is to be stopped for a significant time period.

A primary object of the invention is to provide an improved inking system which is capable of metering a film of ink of a precisely controlled thickness to permit photo-mechanical reproduction of a printing plate in a rotary printing press.

A further object of the invention is to provide an improved inking system comprising a single applicator roller having a substantial mass in combination with a vibrator roller drive mechanism and a positive variable speed drive for the applicator roller which can be driven by the press drive without introducing shock loading which causes gear streaks to be printed on the printed page.

A still further object of the invention is to provide an improved inking system for a lithographic printing press wherein dampening fluid is applied to a single applicator roller prior to inking the printing plate and removed from the applicator roller after inking the printing plate to maintain a reservoir of ink which is substantially free of dampening fluid.

Other and further objects of the invention will become apparent upon referring to the detailed description hereinafter following and to the drawings annexed hereto.

DESCRIPTION OF DRAWING

Drawings of a preferred embodiment of the invention are annexed hereto so that the invention may be better and more fully understood, in which:

FIG. 19 is a schematic diagram of the pneumatic system for actuating various components of the inker;

FIG. 20 is a top plan view of an air circuit valve assembly;

FIG. 21 is a side elevational view of the valve assembly illustrated in FIG. 20.

Numeral references are employed to designate like parts throughout the various figures of the drawing.

DESCRIPTION OF A PREFERRED EMBODIMENT

Figure 1:
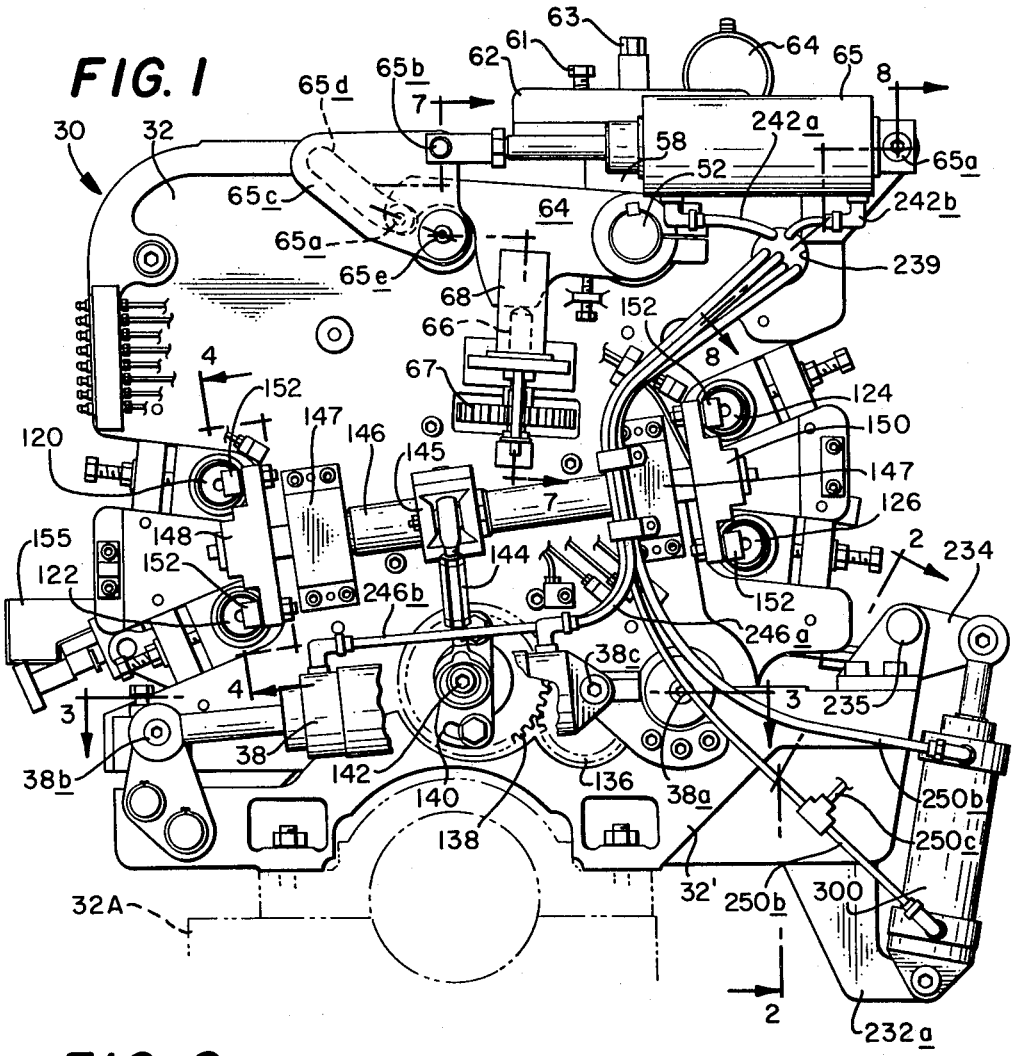
FIG. 1 is an elevational view of the outside of the operator side sideframe of a printing press upon which the ink system is mounted.
Figure 2:
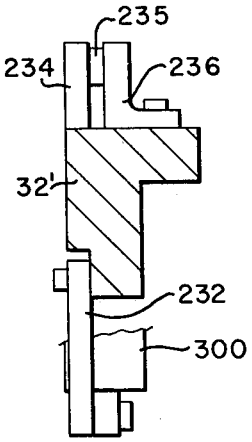
FIG. 2 is a cross sectional view taken along line 2—2 of FIG. 1.
Figure 3:
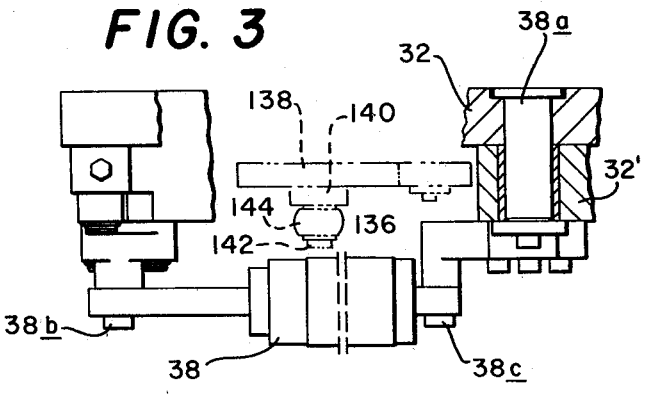
FIG. 3 is a cross sectional view taken along line 3—3 of FIG. 1.

Referring to FIGS. 1, 6, 14 and 17 of the drawings, the numeral 30 generally designates an inker having spaced sideframes 32 and 33 movably secured to adaptor frames 32′ and 33′ secured to sideframes 32A and 32B of a printing press having a conventional plate cylinder 34, blanket cylinder 35, and impression cylinder 36 mounted therein for printing on a web 37 or a sheet of paper. An inker of this type is disclosed in our copending application Ser. No. 06/282,294 filed Jul. 13, 1981 and entitled "Ink Metering Apparatus With Obtuse Metering Member," the disclosure of which is incorporated herein by reference in its entirety for all purposes.

Sideframes 32 and 33 pivot about pins 38*a* and 38*b*, as best illustrated in FIGS. 1, 3, 5, 14, 16 and 18, upon actuation of cylinders 38 which are connected between the adaptor frames 32′ and 33′ and inker sideframes 32 and 33. As will be hereinafter more fully explained, this axis of rotation is aligned with the axis of the dampener transfer roller 300.

Figure 5:
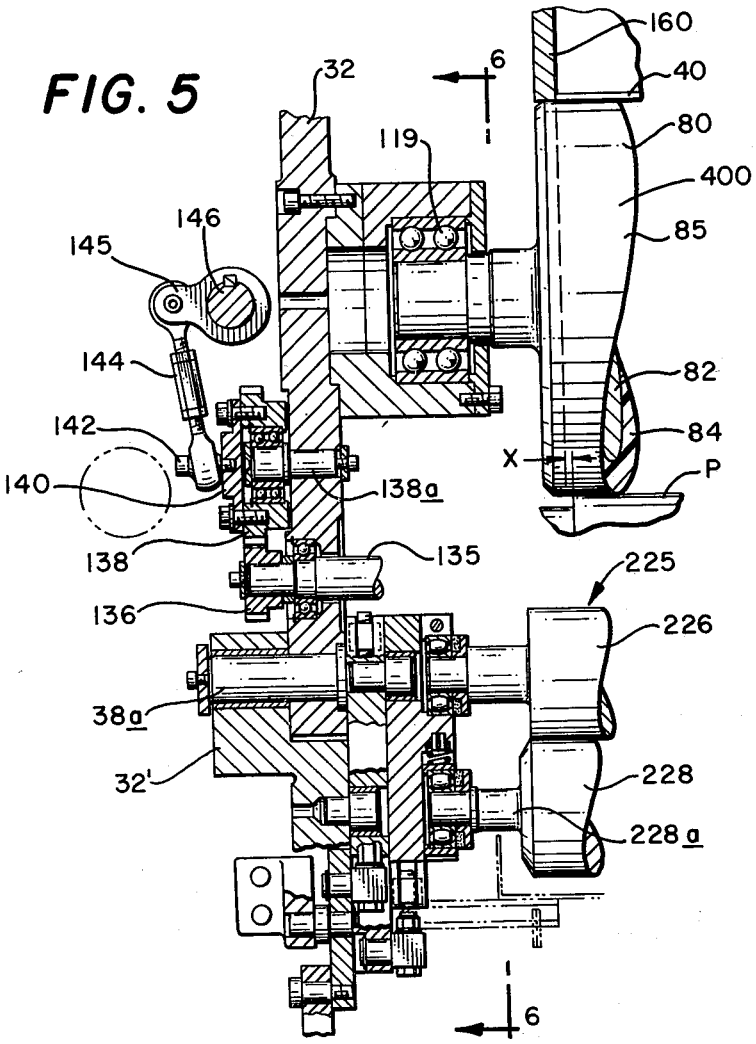
FIG. 5 is a cross sectional view taken along line 5—5 of FIG. 1.
Figure 6:
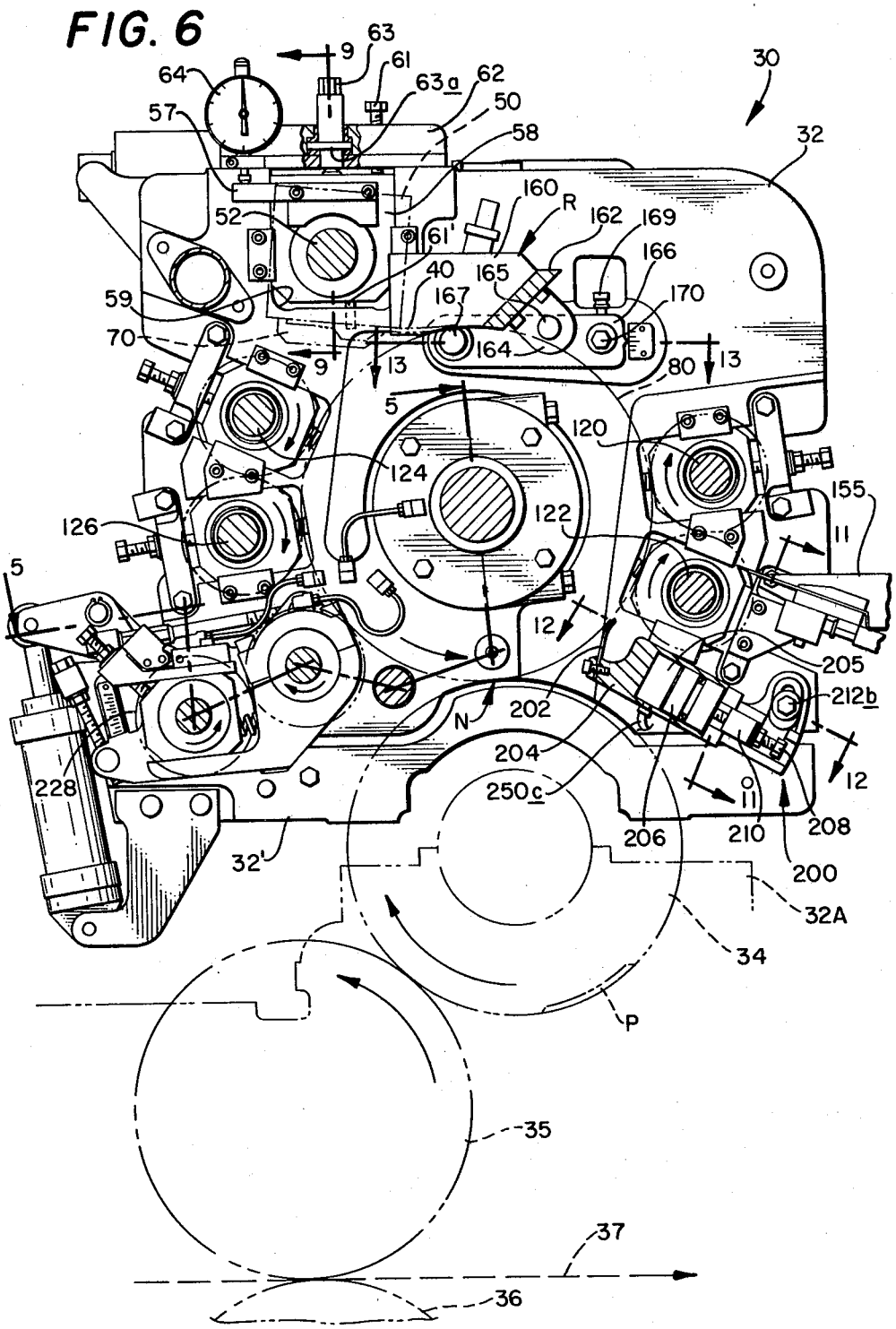
FIG. 6 is a cross sectional view taken along line 6—6 of FIG. 5 illustrating the inside of the operator side sideframe.
Figure 10:
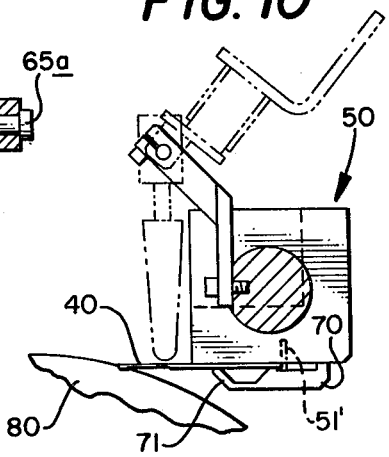
FIG. 10 is a cross sectional view taken along line 10—10 of FIG. 9.
Figure 9:
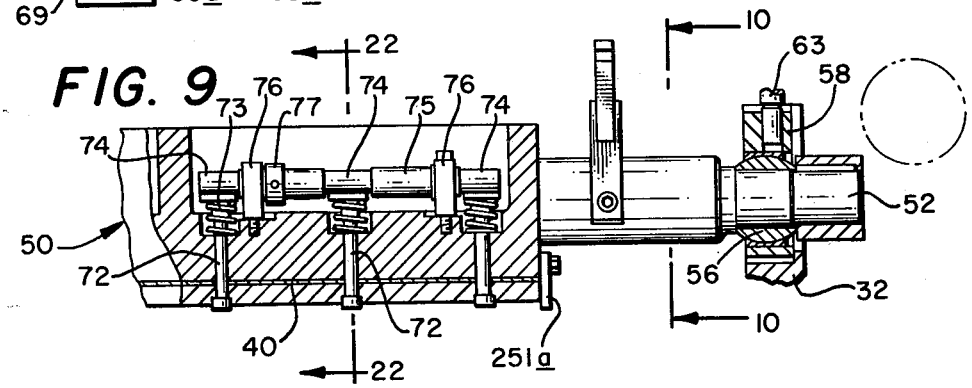
FIG. 9 is a cross sectional view taken along line 9—9 of FIG. 6.
Figure 11:
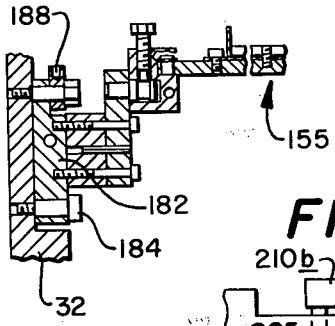
FIG. 11 is a cross sectional view taken along line 11—11 of FIG. 6.
Figure 14:
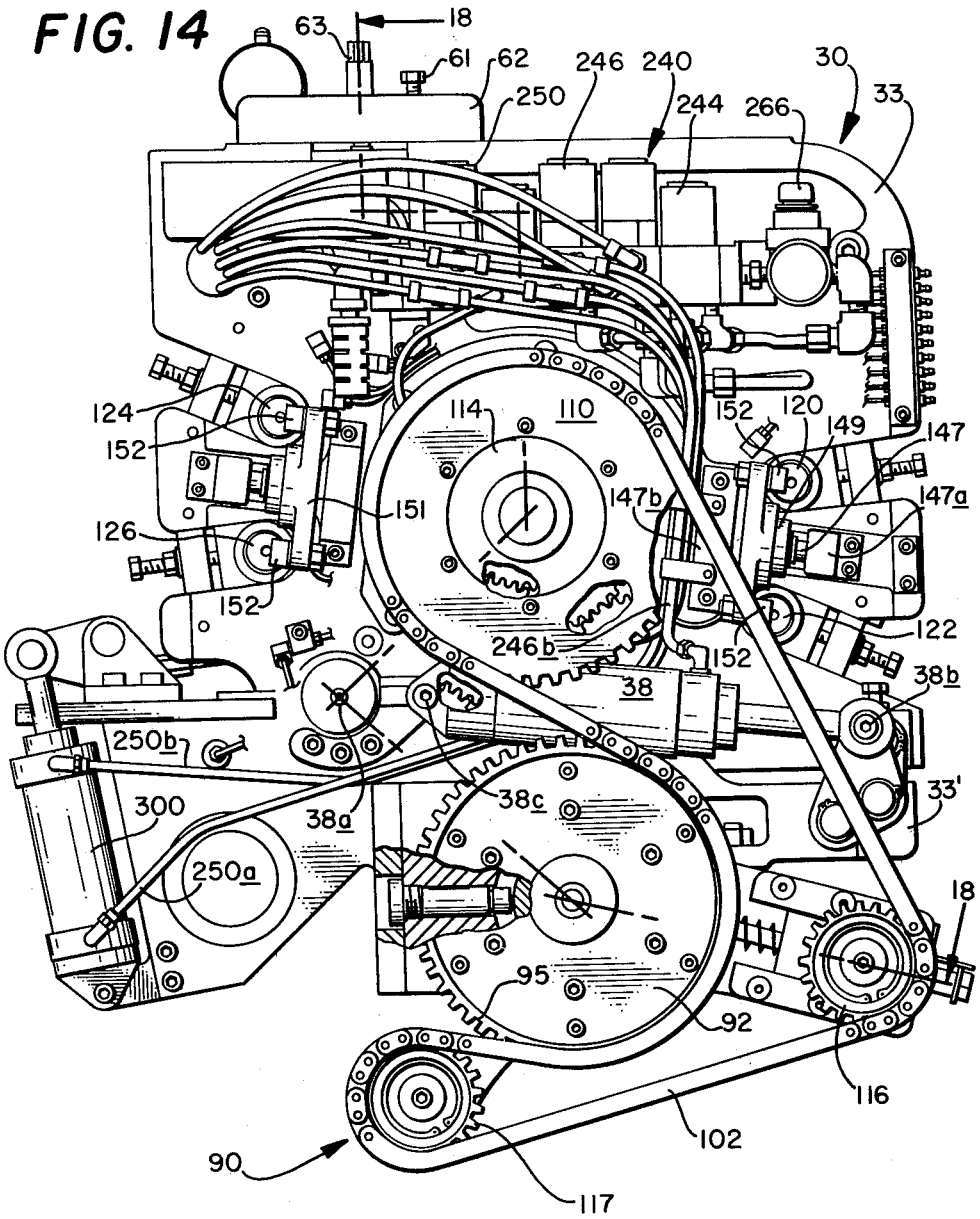
FIG. 14 is an elevational view of the outside of the gear drive side of the inker.
Figure 16:
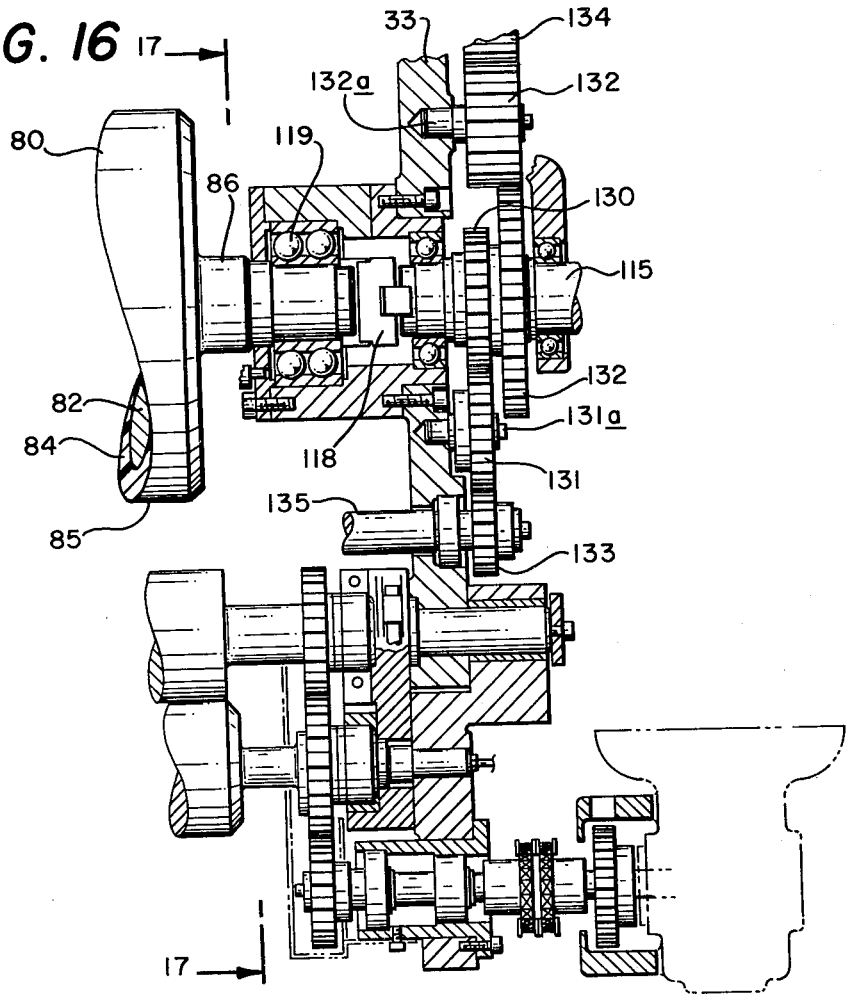
FIG. 16 is a cross sectional view taken along line 16—16 of FIG. 14.
Figure 18:
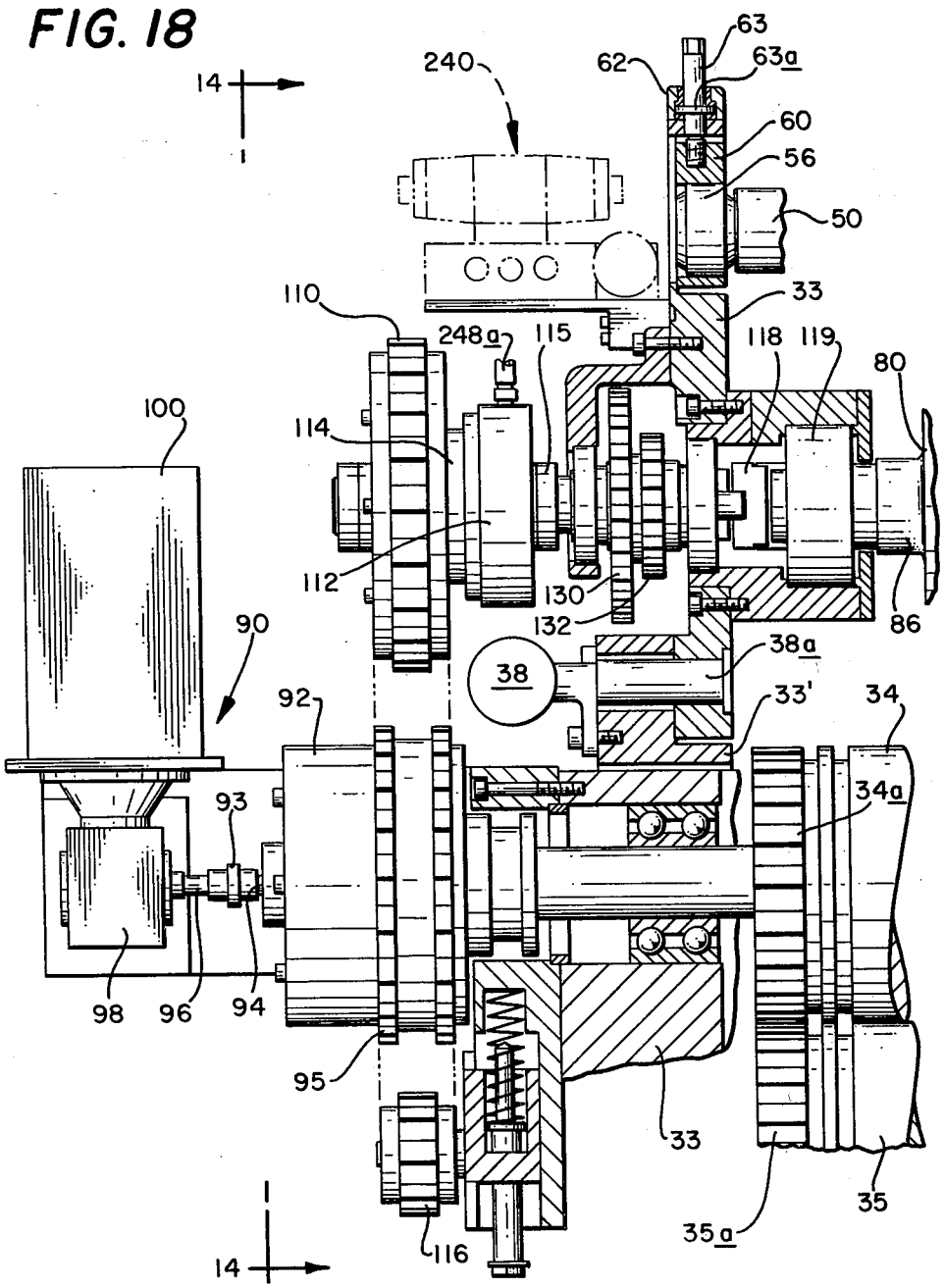
FIG. 18 is a cross sectional view taken along line 18—18 of FIG. 14.

Metering member support means 50, best illustrated in FIGS. 6, 9 and 10, is provided to adjustably secure metering member 40 between sideframes 32 and 33 and to position metering member 40 in relation to a resilient covered applicator roller 80. Opposite ends of applicator roller 80 are rotatably secured to sideframes 32 and 33 in suitable bearings, as illustrated in FIGS. 5, 16 and 18, and applicator roller 80 is driven by a positive infinitely variable speed drive 90 as illustrated in FIGS. 14 and 18. The surface speed of applicator roller 80 is preferably substantially equal to the surface speed of plate cylinder 34.

End dams 160 are in sealing relation with support means 50 and are urged into sealing relation with the periphery of and at opposite ends of applicator roller 80 and member 40 forming a reservoir R from which ink is metered onto the surface of applicator roller 80. One or more ink storage vibrator rollers 124 and 126 are positioned in rolling engagement with ink on the surface of applicator roller 80 for smoothing any surface irregularities which may appear in the ink film before the ink film is carried by the surface of roller 80 to the dampener 225 and to the surface of a printing plate P on plate cylinder 34. Ink storage rollers 124 and 126, having outer covers which are resilient, are in rolling engagement with ink on the surface of applicator roller 40 and not only smooth surface irregularities, but also change a slick metered finish to a smooth matte-like finish for conditioning the ink film for proper dampening and application to an image on a printing plate.

It will be appreciated that as the surface of applicator roller 80 moves away from the surface of the printing plate, the surface is again smoothed and conditioned by ink and dampening fluid storage vibrator rollers 120 and 122 prior to being submerged in ink where an excess of ink is applied thereto at the reservoir R. Ink vibrator roller 120, like rollers 124 and 126, is resilient covered.

Figure 12:
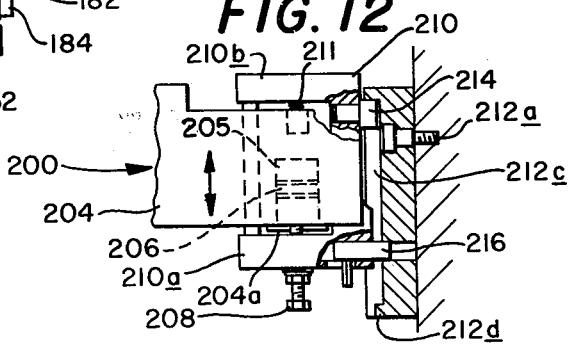
FIG. 12 is a cross sectional view taken along line 12—12 of FIG. 6.

As the inking system is employed for lithographic printing, dampening fluid is applied first to the ink on the surface of the applicator roller 80 and thence to the printing plate P on plate cylinder 34. Dampening fluid removal means 200, best illustrated in FIGS. 6 and 12, are provided for removing dampening fluid from the surface of roller 80 to prevent accumulation of excessive dampening fluid in reservoir R.

Also, the dampening solution could contain more than the normal 5 to 25% alcohol to insure rapid evaporation of the dampening solution from the applicator roller as it travels between the plate and the ink metering member. The alcohol, rollers 120 and 122 and dampening fluid removal device 200, all contribute to the removal and redistribution of excess dampening fluid after printing.

INK METERING MEMBER

Figure 22:
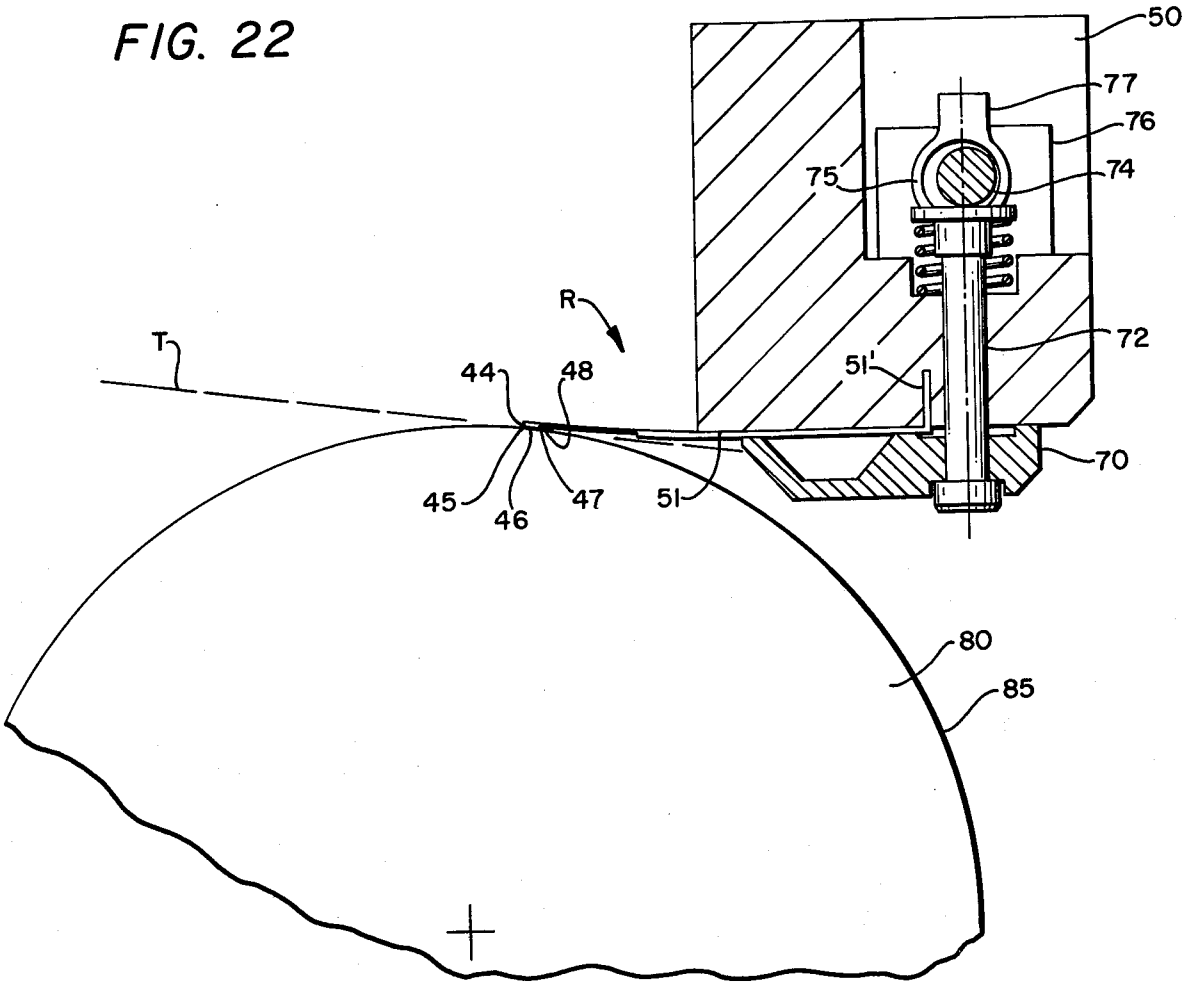
FIG. 22 is an enlarged cross sectional view taken along line 22—22 of FIG. 9.

Referring particularly to FIG. 22, the ink metering member 40 has a smooth, polished, highly developed, precision metering edge 45 which is formed at the juncture of metering surface 44 and support surface 46. Polished surfaces 44 and 46 meet at an obtuse angle to form a wedge having an included edge bevel angle which is approximately 120° or greater.

The edge 45 is preferably formed on relatively hard metallic material having a hardness of about Rockwell C48–50 or higher. It is important that the polished edge 45, metering surface 44, support surface 46, trailing surface 48 and edge 47 be smooth and wear resistant since they are indented into the resilient surface 85 of form roller 80 during normal operating conditions.

Metering member 40 is preferably a resilient, i.e., flexible, metallic, material having a modulus of elasticity of approximately $30\times10^6$ psi, or less, to provide what might be termed a "stylus effect" to the metering edge 45 as the applicator roller 80 rotates.

Metering member 40 has been formed with good results from a strip of Hardened and tempered stainless steel with sheared edges which is commercially available from Sandvik Steel, Inc., Benton Harbor, Mich. and distributed as Sandvik 7C27Mo2. The strip of stainless steel was selected for its hardness, flatness, resilience, grain structure and fine surface finish to provide high wear resistance and good fatigue properties. The stainless steel strip has a thickness of 0.070 inches and a width of approximately 4.0 inches.

The edge 45 must be quite flexible in a lengthwise direction so that when urged into pressure indented relation with the resilient surface of applicator roller 80, the edge 45 will be flexed, yielding to the influence of the surface of roller 80, to conform the edge 45 and the surface of roller 80 to form a substantially uniform indented area along the length of roller 80. As will be hereinafter more fully explained, the resilient cover 85 on roller 80 has a thickness in the range of approximately ⅜ to ⅝ inches, preferably ½ inch, and a resilience of about 40 to 80 Shore A durometer, preferably 60 durometer, Shore A. This loading of edge 45 to obtain conformation with the surface of roller 80 should be possible without excessively indenting the surface of the roller when in a dynamic, running condition.

The edge 45 on metering member 40 should be mounted so that it is resiliently urged toward the surface of the applicator roller 80 and is free for movement along its entire length in a direction radial to the applicator roller as the applicator roller 80 rotates. Also, the edge 45 must be rigidly supported in a direction substantially tangent to the applicator roller surface.

The ideal support for the edge 45 is a flexible cantilever beam which supports the edge 45 and provides the required bias and rigidity. Although the edge 45 may be a part of a separate trapezoidal like element, which is functionally associated with a cantilever beam, it is preferable to form the edge 45 of the trapezoidal portion 10 on the beam so that the two are an integral unit. To accomplish this, the beam must be flexible in two directions; namely, along the length of the edge 45 and also along the width of the strip, i.e., the length of the cantilever beam.

Metering member 40 has a groove or relieved area 42 formed in the lower surface 41 of the strip of material from which metering member 40 is formed.

The portion of the strip of material which will be polished to form polished edge 45 is masked and the metallic material adjacent thereto is removed by chemically milling or by grinding to remove a portion of the metal without creating stresses that would cause the strip of material to warp.

Surfaces 44, 46 and surface 48 adjacent the support surface 46 is smoothed by finish grinding to remove approximately 0.003 inch of rough surface material. These surfaces may then be sanded with 600 grit paper to provide a very smooth surface finish. Edges 45 and 47 are therefore formed on trapezoidal position 10.

If the thickness, the distance between upper and lower surfaces, of the strip of material is 0.070 inches, the depth of the relieved area 42 is preferably greater than 0.020 inches, for example, 0.035 inches, such that the thickness of the material remaining after relieved area 42 is formed is approximately 0.035 inches. Surface 48 intersects the polished support surface 46 at an angle in a range between 30° and 90° as shown.

Upon finishing of the member 40, the member may be further treated to provide extremely good wear resistance by cryogenic (low temperature) treatment which rearranges the molecular structure of the material throughout the material and without warping or altering the hardness of the material.

I have found that included angles of 110° to 160° adequately cover the range of inks encountered in lithographic printing, the smaller angles used for more viscous sheet-fed inks and the larger angles for less viscous web-inks.

METERING MEMBER SUPPORT

Support means for metering member 40 is illustrated in FIGS. 6, 9 and 10 of the drawings. Metering member 40 is secured to a rigid support bar 50 having a ground and true face 51 on one side thereof and having journals 52 and 54 extending outwardly from opposite ends thereof. As best illustrated in FIG. 9 of the drawing, each of the journals 52 and 54 is formed from the square shaped end of support bar 50.

The journals 52 and 54 are rotatably secured in self-aligning bushings 56 in guide blocks 58 and 60 which are slidably disposed in slots 59 in sideframes 32 and 33, respectively.

Figure 17:
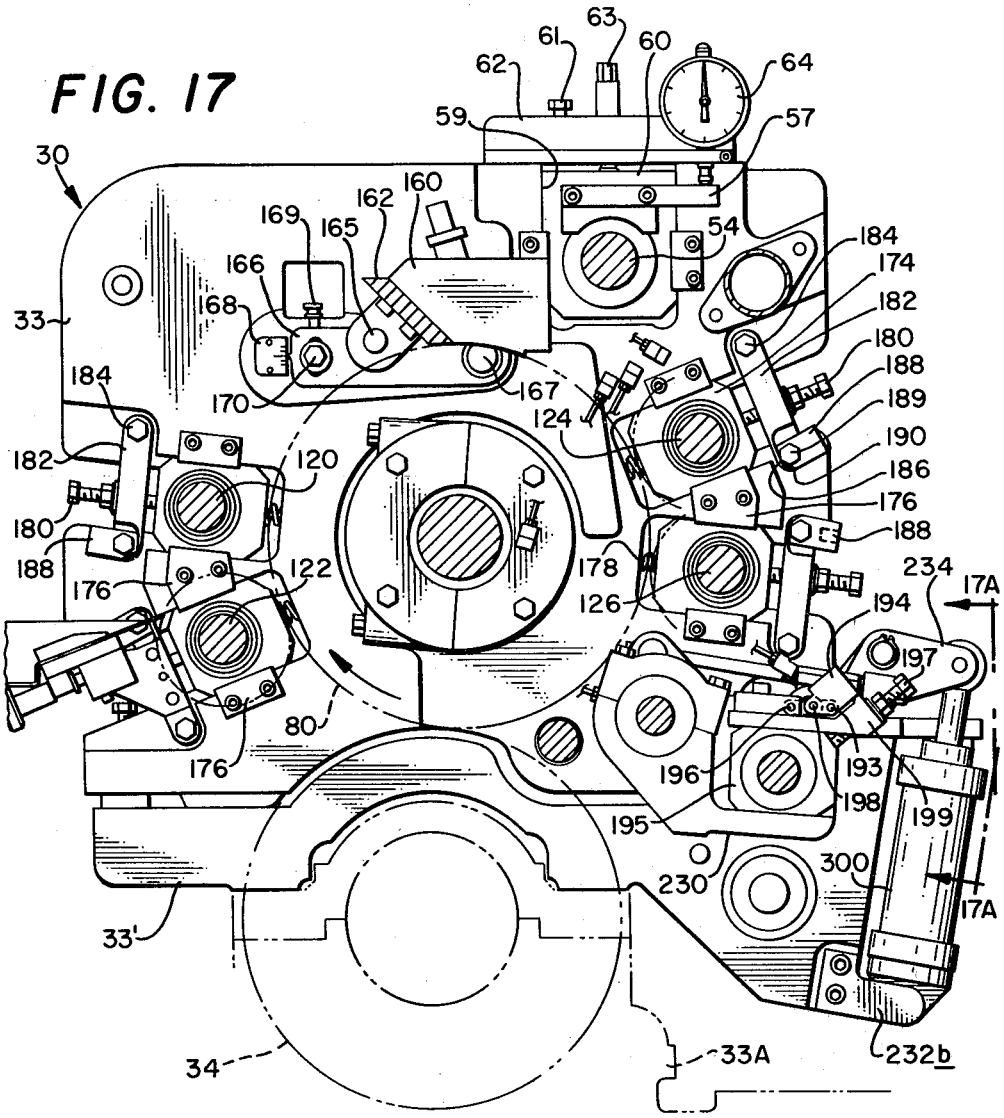
FIG. 17 is a cross sectional view taken along line 17—17 of FIG. 16 illustrating the inside of the gear side sideframe.
Figure 17A:
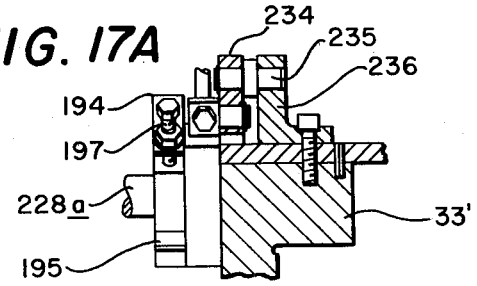
FIG. 17A is a cross sectional view taken along line 17A—17A of FIG. 17.

As best illustrated in FIGS. 6, 9 and 17 of the drawings, rails 62 have opposite ends bolted or otherwise secured adjacent opposite sides of slot 59 in sideframes 32 and 33 and pressure adjustment screws 63, restrained against vertical movement by lock rings **63*a* in openings in rails 62, have a lower threaded end extending into a threaded openings in one of the guide blocks 58 or 60. Thus, rotation of pressure adjustment screws 63 imparts vertical motion to guide block 58 or 60 for moving support bar 50 and metering member 40 relative to the surface 85 of cover 84 of applicator roller 80. Lock-down screws 61 and 61' serve as maximum limits of the position of ends of holder 50, screws 61 and 61' being threaded through rails 62 and inker sideframes, respectively, and engage the upper and lower surfaces of guide blocks 58 or 60. Lock screw 61' is preferably a socket setscrew positioned to engage the lower surface of the guide block 58 or 60** to limit movement of the blocks.

The center line of guide blocks 58 and 60, in which opposite ends of support bar 50 are rotatably disposed, is positioned such that the point of contact of the metering edge 45 on metering member 40 engages the surface 85 of applicator roller 80 at a point which is a few degrees, measured in a counterclockwise direction as viewed in FIGS. 10 and 22, from a line tangent to the roller surface at a point where edge 45 intersects the roller surface. Thus, rotation of adjustment screw 63 changes the angle between the metering surface on the end of metering member 40 relative to a tangential line which results in a change in ink film thickness.

As best illustrated in FIG. 6, each guide block 58 and 60 has a position indicator arm 57 bolted or otherwise secured thereto. The outer end of each position indicator arm is engaged by a dial indicator 64 supported by inker sideframes 32 and 33. Thus, the dial indicator 64 at each side of the printing press can be observed and set to determine when guide blocks 58 and 60 are properly individually adjusted such that the blade edge 45 is precisely parallel to surface 85 of applicator roller 80 and moved together to change the angular relation of the member 40 to roller 80.

In a test to determine the change in color density on a sheet resulting from adjustment of adjustment screws 63, the following results were observed:

| Support Bar Position (In.) | Color Density |
|---|---|
| 0.150 | 1.21 |
| 0.200 | 1.37 |
| 0.250 | 1.57 |
| 0.300 | 1.73 |
| 0.350 | 1.80 |
| 0.400 | 1.87 |

The support bar position was read from dial indicators 64 while the color density of ink printed upon a sheet was measured using a "SOS- 40" digital reflection densitometer, commercially available from Cosar Corporation of Garland, Tex. The support surface on the metering member was substantially tangent to the roller surface and adjustment of screws 63, from a reading of 0.150 inches to 0.400 inches on the dial indicator, changed the angle between the metering surface on the end of the metering member and a line extending radially of the roller passing through the metering edge 45 of member 40.

Adjustment screws 63 are a coarse or rough adjustment of color density while rotation of metering member support bar 50 provides a fine adjustment of color density by changing indentation of the metering edge 45 on the metering member into the resilient surface 85 of applicator roller 80.

As best illustrated in FIGS. 9, 10 and 22 of the drawing, a clamp bar 70, having a flange 71 positioned to engage the lower surface 41 of metering member 40 and to urge the upper surface of metering member 40 into engagement with the ground and true surface 51, is provided for mounting metering member 40 on support bar 50.

Member 40 is accurately located by two pins 51' for parallel alignment prior to being clamped to support surface 51 by clamp bar 70. Axial alignment of metering member 40 relative to roller 80 is provided by an end locator tab **51*a*, as illustrated in FIG. 9, and is secured to one end of support bar 50, the holder 50 being cut back from each end of roller 80**.

As best illustrated in FIGS. 9 and 22 of the drawing, clamp bar 70 is movably secured to support bar 50 by spaced pins 72 which are urged by springs 73 into engagement with metering member 40. A pin collar 77 is rigidly secured to shaft 75 to permit rotation of collar 77 and shaft 75 for moving cam elements 74 spaced along the length of shaft 75 into engagement with upper ends of pins 72 to permit downward movement of clamp bar 70 to release metering member 40 from support bar 50. Support bar 50 is preferably provided with four or more of the cam assembly elements spaced along the length thereof. The flange 71 on clamp bar 70 extends slightly above the upper surface of the mid clamping section of clamp bar 70 so that flange 71 will deflect slightly under the force of springs 73 to assure that the upper surface of metering member 40 is maintained in engagement with the true surface 51 on support bar 50. The relief of the opposite end of clamp bar 70 from end 71 is 0.070 inches.

Figure 7:
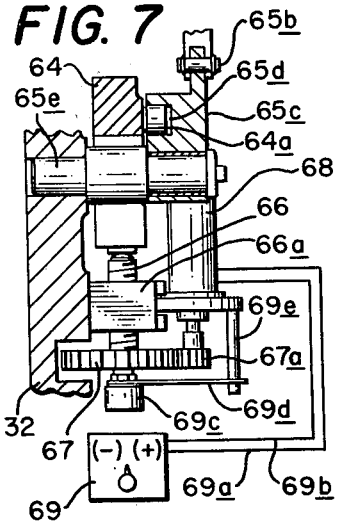
FIG. 7 is a cross sectional view taken along line 7—7 of FIG. 1.
Figure 8:
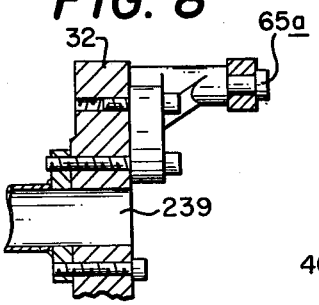
FIG. 8 is a cross sectional view taken along line 8—8 of FIG. 1.

Referring to FIGS. 1 and 7 of the drawing, the journal 54 on the operator side of the inker has a crank arm 64 keyed or otherwise secured thereto. An air cylinder 65 is pivotally secured by a pin **65*a* to the sideframe 32 on the operator side of the inker and has a rod end pivotally secured by a pin 65*b* to bell-crank arm 65*c*. Arm 65*c* is rotatably secured to sideframe 32 by pin 65*c* and has a cam groove 65*d* formed therein to engage cam follower 64*a* on crank arm 64 for rotating crank arm 64 and support bar 50 relative to sideframes 32 and 33 for adjusting indentation of metering edge 45 into the resilient surface 85 on cover 84 of applicator roller 80. The bell-crank arm 65*c* and crank arm 64 are formed to provide a variable mechanical advantage upon actuation of metering member 40**.

As best illustrated in FIGS. 1 and 7 of the drawings, a position screw 66 is threadedly secured to a support member **66*a* bolted or otherwise secured to the operator sideframe 32 in close alignment with metering member edge 45 such that when screws 63 are rotated, only the angle between the surface 44 of member 40 and surface 85 of roller 80 is altered, without a significant change in the indentation of edge 45 into surface 44. Screw 66 has a gear 67 secured to the lower end thereof which is driven by a gear 67*a* on the drive shaft of a motor 68 which is also secured to support member 66*a*. Thus, when motor 68 is energized, position adjustment screw 66 will be rotated thereby limiting movement of crank arm 64 for establishing indentation of metering edge 45 on metering member 40 into the surface 85 of applicator roller 80**.

From the foregoing it should be readily apparent that in the embodiment of the invention illustrated in FIGS. 1 and 7 of the drawing, position adjustment screw 66 is remotely controlled by the direct current electrically driven motor 68. Gears 67 and **67*a* form a gear reducer to reduce the speed or rotation of adjustment screw 66. Motor 66** is commercially available from Globe Industrials Division of TRW, Inc., of Dayton, Ohio.

Conductors **68*a* and 68*b* extend between motor 68, and a motor position control unit 69, which comprises essentially a source of direct current electricity and a three position switch including an off (neutral) position and two positions for rotating motor 68 in opposite directions to move screw 66** up or down.

The motor position control unit 69 preferably has a digital readout indicator (not shown) associated therewith to indicate the position of a rotary potentiometer **69*c* secured to the end of position adjustment screw 66** with a slotted arm 69*d* engaged with pin 69*e* secured to support member 66*a* to provide a visual indication of the position of crank arm 64 and, consequently, the position of support member 50 and metering edge 45 on metering member 40. The output terminals of the potentiometer are connected to the digital readout device calibrated to indicate the position of metering edge 45 and consequently the thickness of the film of ink applied to the sheet or web 37. Motor 68 may be manually or automatically energized to change the thickness of the ink applied to the sheet or web 37.

APPLICATOR ROLLER

The applicator roller 80 comprises a hollow, rigid, tubular metallic core 82 having a resilient non-absorbent cover 84 secured thereto, the cover having a uniformly smooth, uniformly textured, and resilient outer surface 85. The cover 84 on applicator roller 80, while being resilient, is relatively firm, for example, in a range between 40 and 80 Shore A durometer.

As illustrated in FIG. 6 of the drawing, applicator roller 80 is substantially the same diameter as plate cylinder 34. Conventional inking systems generally employ four form rollers which are approximately one-fourth the diameter of the printing plate. Applicator roller 80 preferably has a diameter of approximately 10¼ inches and a thickness of about ⅝ inches and the metallic steel core 82 preferably has a thickness of, for example, one-half inch to provide form roller 80 with sufficient mass and weight to provide a "dampening effect" as a result of the mass and inertia of the roller. As will hereinafter be more fully explained, streaks on printed sheets which have been heretofore referred to as "gear streaks" have been eliminated in presses upon which the inking system disclosure has been tested. As will hereinafter be more fully explained, several features of the present invention contribute to the elimination of "gear streaks." However, the mass of applicator roller 80 offers a significant contribution.

The cover 84 on applicator roller 80 is preferably formed of a resilent polyurethane or rubber-like material attached to a metallic core 82. The cover can be made from Buna Nitrile rubber which provides a natural surface having microscropic pores to receive and hold ink therein to enable metering a thin ink film suitable for lithographic printing applications.

The cover 84 on applicator roller 80 should have high tensile strength, excellent tear and abrasion resistance, and resistance to oils, solvents and chemicals. The cover should, furthermore, have low compression set, good recovery, and uniform ink receptivity. A suitable cover can be formed using polyurethane or rubber to form a resilient cover preferably of about 60 Shore A durometer.

A suitable polyurethane cover may be made from a blocked, pre-catalized, strained and pure material, having a 2% filler added, which is commercially available from Arnco in South Gale, Calif., under the trademark "Catapol". The material is pre-heated at 160° F. for five hours, poured into a mold around the roller core, and then heated to 280° F. for 8½ hours, and allowed to cool prior to grinding and polishing.

If no filler is in the material, ink will not readily attach itself to the roll surface and if a high filler content is used ink will not be readily metered from the roll surface. Tear strength is also lost will a high filler percentage. Clay is normally used as a filler material.

A suitable rubber cover may be obtained from Mid-America Roller Company, Arlington, Tex., and specified as Buna-Nitrile which is conventionally attached and formed over the core and ground with a high-speed grinder prior to polishing.

After a resilient cover 84 of either polyurethane or rubber has been formed, the roller may have a slick glazed outer skin or film over the surface thereof which is removed by grinding. After grinding with a 120 grit rock, the surface of resilient cover 84, if constructed of polyurethane, is sanded by using 180 grit sandpaper to form a surface of uniform smoothness over the surface 85 of the resilient cover 84. However, after grinding with a 120 grit rock, the surface of resilient cover 84, if constructed of rubber, is sanded with 800 grit sandpaper to insure a velvet smooth, uniformly textured surface, free of "orange peel" or other surface irregularities.

Microscopic reservoirs into which ink is attached help to assure that a continuous unbroken film of ink is maintained on the surface 85 of applicator roller 80.

Surface scratches, grind lines, and other surface irregularities should be removed so that the surface roughness of the surface of either polyurethane or rubber after sanding does not exceed 30 RMS. As will be hereinafter more fully explained, adhesive force between molecules of ink and molecules of the surface 85 of cover 84 must exceed cohesive force between ink molecules to permit shearing the ink to form a controlled, continuous, unbroken film of ink on the surface 85 of applicator roller 80.

It will be appreciated that it is physically impractical, if not impossible, to construct and maintain roller 80 such that surface 85 is perfectly round in a circumferential direction, perfectly straight in a longitudinal direction, and precisely concentric to the axis of core 82. The straightness or waviness of surface 85 on roller 80 can be economically manufactured within a tolerance of about 0.002 inches along the length of roller 80 and the radial eccentricity can be economically manufactured within a tolerance of about 0.0015 inches. Abrupt changes in physical properties of the material, in the roller surface, in the durometer, or, in the thickness of the cover 84, can adversely affect ink metering and therefore color.

In FIG. 5, ends of roller 80 are shown bevelled to provide support at the ends such that pressure between edge 45 of member 40 and roller surface 85 of roller 80 is uniform along the entire length of edge 45. It is advantageous, as shown in FIG. 5 for the ends of the member 40 to extend beyond the ends of plate P on cylinder 34, a distance shown as "X," i.e., at least, ⅛ inches. A small bead of ink has been known to form at the intersection of the metering member and the end dam.

A Shore A durometer test is generally used to indicate the hardness of a resilient roller cover by measuring resistance to penetration at a constant temperature of about 76° F. while the resilient cover is stationary. The apparent hardness of a resilient surface under dynamic conditions deviates radically from the hardness indicated by the durometer test under static conditions. The spring constant of a resilient material so increases slightly as deformation increases.

As the frequency of loading of a resilient member increases, the dynamic modulus or apparent modulus of elasticity increases causing the cover to appear as a harder, stiffer material. However, cyclic loading of a resilient member results in generation of internal heat which increases temperature and results in a decrease in the durometer and therefore the modulus of elasticity of the resilient cover.

Further, since the surface 85 of cover 84 on roller 80 is preferfably in pressure indented relation with the surface of a plate cylinder, the plate cylinder having a gap extending longitudinally thereof, this cyclic loading will result in generation of heat at an irregular rate circumferentially of the surface 85. Such temperature differences over surface 85 may cause an appreciable variation in the radial distance from the axis of the roller 80 to points over the surface 85, because the co-efficient of thermal expansion of elastomeric materials employed for forming resilient roller covers is several times the co-efficient of thermal expansion, of e.g. steel.

Also, as temperatures change, thermal expansion changes pressures between adjacent surfaces and therefore nip widths and relative surface speeds also change between the adjacent members in pressure indented relation.

As shown, roller 80 can be and is desirably different in diameter than the plate cylinder 34 without adversely affecting printing of the film 400 to the web 37, or sheet, since metering member 40 produces a smooth, continuous ribbon of ink on the applicator roller surface regardless of influences of the prior impression and regardless of normal dynamics in printing operations.

The applicator roller 80 should not be exactly the same diameter as the plate cylinder 34, because even the slightest defect, hole, or flaw in the surface of the applicator roller 80, would be repeated in the same place on the plate when the two are driven at the same surface speed and are the exactly same diameter. This repeat, especially when printing to a lithographic plate, eventually causes sensitizing of the non-image area. The flaw will then appear as ink on the printed sheet in the non-image area. If the flaw occurs in the image area, eventually a light spot in the ink will appear in this area. Therefore, it is imperative that the surface of the applicator roller 80 not repeat with the surface of the plate on the plate cylinder. It has been observed that with the absence of a repeat, the flaw, even when considered excessive, will not sensitize a lithographic plate in the non-image area.

APPLICATOR ROLLER DRIVE

Applicator roller 80 is positively driven by a speed control device 90 of the type disclosed in copending application Ser. No. 06/314,043, filed Oct. 22, 1981, entitled "Inker Form Roller Drive," the disclosure of which is incorporated herein by reference in its entirety for all purposes.

Figure 15:
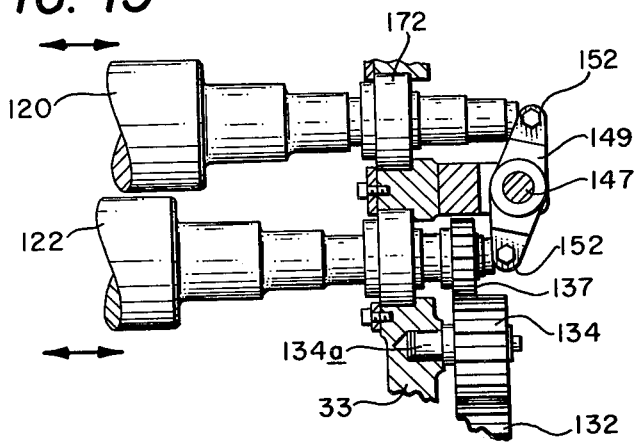
FIG. 15 is a cross section view taken along line 15—15 of FIG. 14.

FIGS. 14 and 15 illustrate a lithographic printing press drive wherein a blanket cylinder 35 and plate cylinder 34 are conventionally driven by a printing press drive gear (not shown) which is conventionally driven by a motor (not shown) which imparts rotation to blanket cylinder gear 35*a* which is disposed in meshing relation with plate cylinder gear 34*a*. Blanket cylinder gear 35*a* and plate cylinder gear 34*a* are drivingly secured to blanket cylinder 35 and to plate cylinder 34, respectively.

Plate cylinder gear 34 is mounted on journalled shaft ends of the plate cylinder which is axially aligned with and supports plate cylinder 34. Journal shaft ends of cylinder 34 are rotatably supported by bearings in openings in the press sideframes. A conventional plate and blanket are attached to the plate and blanket cylinders.

A positive, infinitely variable, speed control device (PIV) generally designated by the numeral 90 is mounted for transmitting power from the press drive, for example, from the plate cylinder shaft to applicator roller 80, as will be hereinafter more fully explained. In the particular embodiment of the invention illustrated in FIG. 18 of the drawing, the positive, infinitely variable, speed control device 90 is a harmonic drive, which incorporates pancake gearing, which is available from U.S.M. Corporation, Harmonic Drive Products, Icon Division, of Wobum, Mass., USA.

Speed control device 90 comprises a dynamic spline (not shown) within the harmonic drive bolted or otherwise secured to a sleeve drivingly secured to the plate cylinder shaft. The dynamic spline comprises a circular ring having teeth on its inner surface to form an internal gear and is positioned adjacent to a circular spline bolted to a connector hub 92 which is bolted or otherwise secured to a sprocket 95. Sprocket 95 has a central opening and is supported by bearings which are positioned about the outer surface of the sleeve secured to plate cylinder shaft.

The circular spline, connector hub 92 and sprocket 95 are rotatable relative to the dynamic spline and the plate cylinder shaft.

An elastic steel ring having external spline teeth on the outer surface thereof is rotatably mounted on an elliptical bearing or wave generator and a rotating input element keyed or otherwise connected to input shaft 94. The elliptical bearing has an elliptical shaped outer surface which engages the inner surface of the elastic steel ring. Rotation of the input element and the elliptical bearing causes the elastic steel ring disposed about the outer periphery thereof to be deformed in a wave-like manner. The elastic steel ring extends into the dynamic spline and the circular spline such that teeth on a portion of the periphery of the ring engage internal teeth on the dynamic spline and on the circular spline along diametrically opposed portions of the dynamic and circular splines.

Thus, when assembled, rotation of the elliptical bearing and the input element imparts a rotating elliptical shape to the elastic steel ring causing progressive engagement of these external teeth with the internal teeth of the dynamic spline and the circular spline.

The circular spline has two more teeth than the elastic steel ring, thereby imparting relative rotation to the elastic steel ring at a reduction ratio corresponding to the number of teeth. The dynamic spline has the same number of teeth as the elastic steel ring, therefore it rotates with and at the same speed as the elastic steel ring. Thus, the circular spline establishes the positive transmission reduction ratio equal to one-half the number of teeth on the elastic steel ring.

A flexible coupling 93 is connected between input shaft 94 and output shaft 96 of a right-angle gear reducer 98 which is driven by a variable speed, direct current, electric motor 100, the speed of which is controlled by a tachometer-generator circuit (not shown), which causes the speed of motor 100 to be maintained in a selected speed ratio relative to the speed of the printing plate 34.

DC motor 100 is connected through suitable circuitry (not shown) for maintaining a desired speed relationship between the press drive and motor 100 and ultimately between form roller 80 and plate cylinder 34.

A silent chain 102 extends about a portion of the periphery of sprocket 95 and engages teeth on sprocket 110 which is bolted or otherwise secured by an air clutch 112 to a drive shaft 115 which is drivingly connected to journalled end of 86 applicator roller 80. Air clutch 112 comprises an input segment 114 and an output segment 115 for permitting rotation of drive shaft 115 in one direction only.

As illustrated in FIG. 14 of the drawing, the tension in silent chain 102 is maintained by a pair of idler sprockets 116 and 117. Idler sprocket 116 is spring urged away from the axis of plate cylinder 34 so that sprocket 116 may move inwardly toward the axis of plate cylinder 34 when surfaces of applicator roller 80 and the plate cylinder 34 are separated, for example, when the inker is moved to an "off impression" position.

The output segment 115 of clutch 112 has a drive shaft supported by bearings and connected through a coupling 118 to the applicator roller journal 86 which is rotatably supported by bearings 119.

It has been observed that when a roller having a resilient surface is urged into pressure indented relation with a hard surfaced roller, and the rollers are frictionally driven with a dry nip therebetween, the surface speed of the resilient roller will be less than the surface speed of the hard surfaced roller. Further, it has been observed that when the indentation between the resilient roller and the hard roller is adjusted, the relative speeds of the rollers will change, the surface speed of the resilient roller decreasing relative to the surface speed of the hard surfaced roller as the indentation is increased.

It should be readily apparent that speed control device 90 permits adjustment of the surface speed of applicator roller 80 relative to the surface speed of plate 34 for causing applicator roller 80 to be driven at a desired surface speed even though the diameters of cylinders 80 and 34 may change as a result of thermal expansion or if it is necessary, under certain operating conditions, to adjust pressure at the nip N between the applicator roller 80 and printing plate 34. This is sometimes necessary under normal operating conditions for applying different inks to different printing plates to prevent scumming and slurring, to maintain a proper dot size, shape and dimension.

It is contemplated that speed control device 90 will normally be employed for making very slight changes in the relative surface speed of the applicator roller 80 relative to printing plate cylinder 34, for example, the surface speed of the surface 85 on applicator roller 80 might only be changed a maximum of about two or three percent of the surface speed of plate P on plate cylinder 34 for establishing the desired speed relationship between the roller surfaces.

As noted herein before, the primary function of speed control device 90 is to drive applicator roller 80 in a true rolling relationship relative to the plate cylinder 34 to prevent undesirable deformation and, skidding, of the resilient surface of applicator roller 80 at the nip N between the rollers.

We have observed that when the applicator roller drive 90 is adjusted to assure that the surfaces of the applicator roller 80 and plate cylinder 34 are in true rolling relation, the terminology generally referred to as "gear streaks" is not observed on printed sheets. This is believed to result from the fact that applicator roller 80 has sufficient size and mass to provide a substantial inertia, which when combined with a smooth and true rolling relationship between the applicator roller 80 and plate cylinder 34, minimizes disturbance to the rotation of the cylinders and results in a smooth even printed ink film on the sheet or web 37.

VIBRATOR ROLLER DRIVE

A prime safety consideration in the design of the vibrator drive is to have all major drive components, which oscillate and/or rotate the vibrators, to be located on the outside of the inker sideframes and to enable quick removal of the vibrators from the inker.

The mechanism for oscillating vibrator rollers 120 and 122 and vibrator rollers 124 and 126 is best illustrated in FIGS. 1, 4, 5, 14, 15 and 16. As best illustrated in FIGS. 5 and 16, the journal 86 of applicator roller 80 is rotatably mounted in bearings 119 to the gear side sideframe 33 of the inker. As hereinbefore described, journal 86 is connected through a coupling 118 to the output of shaft 115 of clutch 112. Shaft 115 has a pair of gears 130 and 132 mounted thereon, as best illustrated in FIGS. 16 and 18. Gear 130 is disposed in meshing relation with an idler gear 131 mounted on a stub shaft 131*a* on the gear side sideframe 33 of the inker. Idler gear 131 imparts rotation to a gear 133 on a cross shaft 135 having opposite ends rotatably journaled in sideframes 32 and 33 of the inker.

The end of cross shaft 135 which is rotatably journaled in the operator side sideframe 32 has a gear 136 mounted thereon in meshing relation with a gear 138 rotatably supported by a stub shaft 138*a* on operator side sideframe 32. Gear 138 has a crank plate 140 adjustably secured to the surface thereof as best illustrated in FIG. 1 of the drawing. Crank plate 140 supports an eccentrically located crank pin 142 which is pivotally connected to one end of a link 144, the other end of which is pivotally connected to a crank arm 145 which is keyed or otherwise secured to a rocker shaft 146 mounted in bearings in bearing blocks 147. Rocker arms 148 and 150 are mounted on opposite ends of rocker shaft 146 and have eccentric shaft cam follower rollers 152 rotatably secured thereto.

Figure 4:
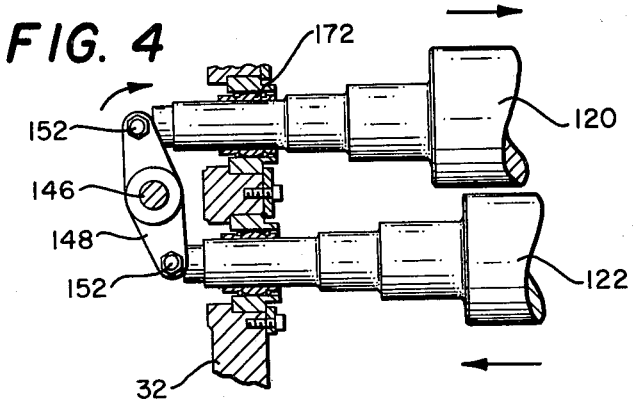
FIG. 4 is a cross sectional view taken along line 4—4 of FIG. 1.

As best illustrated in FIGS. 1 and 4 of the drawing, rollers 152 having shafts eccentric to the roller portion alternately push vibrator rollers 120 and 122 to the gear side as viewed in FIG. 4 of the drawing. Eccentric shaft cam follower rollers 152 may be adjusted in rocker arms 148 and 150 to take up manufacturing tolerances to eliminate looseness in the engagement with the ends of vibrator rollers 124 and 126. The rollers 152 on rocker arm 150 similarly operate vibrator rollers 124 and 126.

From the foregoing it should be readily apparent that rotation of shaft 115 imparts rotation to journal 86 of roller 80 and gear 130 that imparts motion to idler gear 131 which in turn imparts rotation through gear 133, cross shaft 135 and gear 136 to gear 138 which in turn rotates crank plate 140. Rotation of adjustable crank plate 140 imparts sinusoidal reciprocating motion through pin 142 to link 144 to the crank arm 145 for imparting rotary oscillation to rocker shaft 146. Rotation of rocker shaft 146 in a clockwise direction that is viewed in FIG. 4 of the drawing urges the end of vibrator roller 120 to the right as viewed in FIG. 4.

Referring now to FIG. 15 of the drawing, movement of vibrator roller 120 to the right causes force to be exerted by the end of vibrator roller 120, through roller 152 on rocker arm 149 mounted on a stub shaft 147 rotatably secured between bearings in bearing blocks 147*a* and 147*b* on the gear side sideframe 33.

As rocker arm 149 rotates in a clockwise direction as illustrated in FIG. 15 of the drawing, force is exerted through roller 152 on the lower end of rocker arm 149 for urging vibrator roller 126 to the left as viewed in FIG. 15.

As will be hereinafter more fully explained, vibrator roller 122 is used as a washup roller and therefore is preferably positively rotatably driven while the other vibrator rollers 120, 124 and 126 are idler rollers rotatably driven through friction contact with roller 80. As best illustrated in FIGS. 15 and 16 of the drawing, the gear 132 on output shaft 115 of the clutch 112 which drives applicator roller 80 is positioned with meshing relation with idler gears 134 in meshing relation with a gear 137 keyed or otherwise secured to the end of vibrator roller 126. Thus, vibrator roller 126 is positively driven and will rotate even when lightly striped in to the surface of applicator roller 80, when engagable with a washup blade, or when the surfaces of applicator roller 80 and vibrator roller 126 are covered with a relatively slick, thin washup solution.

From the foregoing it should be readily apparent that vibrator rollers 120 and 122 oscillate in opposite directions and when reversing direction will apply a substantially balanced load to rollers 152 on rocker arms 148 and 149. Similarly, vibrator rollers 124 and 126 move in opposite directions and exert substantially uniform loading to vibrator roller ends through rocker arms 150 and 151 adjacent opposite sides of the inker.

The vibrator roller drive hereinbefore described, because of the movement of the various rollers in opposite direction simultaneously, does not apply an oscillatory loading on the form roller either circumferentially or axially thereof. Thus, the vibrator roller drive mechanism contributes to elimination of any gear and virtually all other streaks which have heretofore been observed in virtually all rotary printing presses.

As hereinbefore noted, vibrator roller 122 is positively driven to facilitate use of that roller as a washup roller for removing ink from the inked rollers. As best illustrated in FIGS. 1 and 6 of the drawings, a washup tray 155 is positionable for positioning a doctor blade in engagement with the surface of roller 122 for scraping ink and a washup solution from the surface of roller 122 for removing all of the ink from the inked rollers 80, 120, 122, 124 and 126 when applicator roller 80 is thrown off impression and out of engagement with the plate cylinder 34 and separated from dampener D.

As best illustrated in FIGS. 4, 6 and 17 of the drawings, opposite ends of vibrator rollers 120, 122, 124 and 126 are rotatably secured in self-aligning sleeve bearings 172 mounted in slide blocks 174 which slide in grooves formed in the inker sideframes 32 and 33, respectively, and are captured in position by retainer plates 176. Each slide block 174 is urged in a direction away from the surface of applicator roller 80 by a spring 178. A pressure adjustment screw 180 is threadedly secured in a support bar 182 which engages the upper surface of the slide block 184. Thus, a stripe between applicator roller 80 and each of the vibrator rollers 120–124 is adjustable by the rotation of the pressure adjustment screw 180.

As best illustrated in FIG. 17 of the drawing, each support bar 182 is mounted to provide a "night latch" to facilitate reducing pressure between vibrator rollers 120–124 and applicator roller 80 when the press is to be stopped for any substantial period of time. One end of support bar 182 is pivotally connected by a pin 184 to the inker sideframe. The opposite end of support bar 182 is urged inwardly by an end surface 186 on a latch member 188 pivotally connected by a pin 189 to the inker sideframe. When latch member 188 is in the position illustrated in FIG. 17, pressure adjustment screw 180 carried by support bar 182 will urge slide block 184 to a position wherein the vibrator roller carried thereby is urged into engagement with the applicator roller 80 to establish a predetermined pressure. Latch member 188 has a second surface 190 on a side, surface 190 being spaced radially closer to the axis of pin 189 than is the end surface 186. Thus, when latch member is rotated 45° as viewed in FIG. 17 of the drawing, end surface 186 will be disengaged from support bar 182 so that spring 178 will urge slide block 174, pressure adjustment screw 180 and support bar 182 away from the surface of applicator roller 80 into engagement with the second surface 190. This reduces pressure between the surfaces of applicator roller 80 and vibrator rollers 120–124 to prevent the formation of a stripe (permanent set) on the curved surfaces of the rollers which may result when the rollers are left urged into pressure indented relation for a significant period of time while the rollers are not rotating.

Each latch member 188 has a pin wrench socket formed in the end thereof to facilitate actuation of the latch mechanism between the "on impression" and "off impression" positions. The pressman need only insert the wrench in the pin wrench socket and rotate latch member 188 through an angle of 45° to establish or relieve pressure between surfaces of the vibrator rollers and the applicator roller 80.

END DAMS

Figure 13:
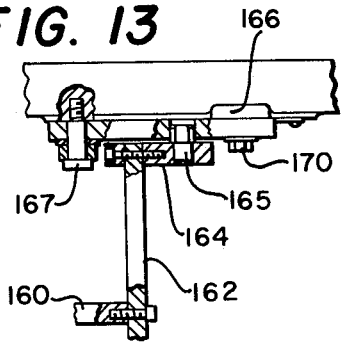
FIG. 13 is a cross sectional view taken along line 13—13 of FIG. 6.

End dams 160 illustrated in FIGS. 6, 13 and 17 comprise a pair of plates secured together by a transversely extending member 162 which forms the rear wall of the reservoir R defined between end dams 160 and bounded on the front side by metering member 40 and holder 50.

Each end dam 160 and transverse member 162 is supported by a lug 164 pivotally secured to arm 166 by pin 165. Pin 165 is supported in arm 166 that has one end pivotally secured by a pin 167 to the inker sideframes. The opposite end of the arm 166 has a pointer formed thereon which moves adjacent indicia plates 168 to facilitate aligning transverse extending member 162 parallel to the surface of the roller 80 and for establishing the optimum sealing relationship between end dams 160 and the ends of applicator roller 80, as will be more fully explained. End dam alignment screw 169 are threadedly secured to arms 166 adjacent each side of the printing press and engage locking screws 170 inside frames to permit movement of each of the arms 166 adjacent opposite sides so that they will be positioned precisely parallel. Locking screws 170 secure each arm 166 in position after the optimum parallel relationship has been established.

Each end dam 160 has a curved and ground lower surface which has a radius of curvature equal to the radius of curvature of the outer surface of applicator roller 80 and is urged into sealing relation with opposite ends of applicator roller 80 by force of gravity or by an adjustable spring biased means for the dams 160 and member 162 about pivot pin 165.

DAMPENING FLUID REMOVAL DEVICE

Referring to FIGS. 6 and 12 of drawing, the numeral 200 generally designates a dampening fluid removal device of the type disclosed in International Application Ser. No. PCT/US81/01213, filed Sept. 8, 1981, entitled "Dampening Fluid Removal Device," the disclosure of which is incorporated herein by reference in its entirety comprising a doctor blade 202 secured to a support bar 204 having cylindrical openings 205 formed in opposite ends thereof. A piston 206 extends into each of the cylindrical openings 205 and is limited in travel by stop lug 104*a* secured to support bar 204 which engage adjustment screws 208 extending through lugs 210*a* on U-shaped mounting brackets 210 to adjust the position of the support bar when the cylindrical openings 205 are pressurized. Springs 211 in support bar 204 engage a second lug 210*b* on the U-shaped mounting bracket for urging support bar 204 to a position separating doctor blade 202 from the surface of applicator roller 80 when the cylinders are depressurized.

Mounting brackets 210 are pivotally connected by pins 214 to Haner 212 secured to sideframes 32 and 33 by screws 212*a*. Hangers 212 can be rotated about screws 212*a* by loosening lock screws 212*b* which extend through an arcuate slot in hanger 212 to adjust the angle of engagement of doctor blade 202 relative to applicator roller 80.

Dampening fluid removal device 200 may be removed from its mounted position and rotated for cleaning by disengaging locking pins 216 from hangers 212 allowing pivot pins 214 to slide down stepped slots 212*c* and engage lugs 212*d*.

As will be hereinafter more fully explained, pressurized air is delivered into chamber 205 when the dampening system is thrown "on-impression" for moving doctor blade 202 into engagement with the surface of applicator roller 80. When the dampener is thrown off impression, pressurized air is exhausted from chamber 205 and spring 211 moves doctor blade 202 out of engagement with surface of applicator roller 80.

PNEUMATIC CONTROL SYSTEM

The pneumatic control circuit 240 as illustrated in FIGS. 1, 14, 18, 19, and 20 delivers pressurized air to cylinder 38 which moves applicator roller 80 into pressure indented relation with the plate cylinder 34; the cylinder 65 which urges the metering member 40 into indented relation with the resilient surface 85 of the applicator roller 80; the cylinders 300 which moves the hyrdophilic dampening fluid transfer roller into pressure indented relation with the applicator roller 80; the cylinder 205 which urges the doctor blade 202 into pressure indented relation with the applicator roller 80 to remove dampening fluid; and the air clutch 112 which transmits torque to rotate applicator roller 80. In FIGS. 14 and 19 of the drawing, solonoids 242 and 244 control the indentation of metering member 40 into the resilient surface 85 of applicator roller 80.

Solonoid 246 controls the flow of pressurized fluid through lines 246*a* and 246*b* to cylinders 38 adjacent opposite sides of inker for moving applicator roller 80 into and out of pressure indented relation with the printing plate 34.

Solonoid 248 is connected to actuate clutch 112 through line 248*a*.

Solonoid 250 actuates cylinders 300 through lines 250*a* and 250*b* which move the hydrophilic dampening fluid transfer roll 226 "on" or "off" and also controls the single acting cylinders 205 through line 250*c* which moves the dampening fluid removal blade into and out of engagement with a surface of the applicator roller 80. It will be noted that a single solonoid 250 causes cylinders 205 and 300 to be actuated simultaneously. Thus, when the dampener is thrown on for delivering dampening fluid to the applicator roller 80, the cylinder 205 will be actuated simultaneously for removing said dampening fluid from the applicator roller 80.

The pneumatic control circuit 240 comprises a source of pressurized fluid 252, such as an air compressor which delivers pressurized fluid through a pressure regulator 254 for establishing a line pressure of, for example, 80 pounds per square inch to high pressure line 255.

Each of the solonoid actuated valves 244–250 is of identical construction and are illustrated in an energized position. As illustrated in FIG. 19 of the drawing, high pressure line 255 is connected to a central inlet port of each of the solonoid actuated valves.

In the energized position as illustrated in FIG. 19 of the drawing, each of the cylinders 38, 65, 205 and 300 is actuated to extend rods in the cylinders by pressure from high pressure 255 while the rod end of each of the cylinders is connected through an exhaust port of valves 242, 246, 248 and 250 to a low pressure or exhaust line 257. Further, high pressure line 255 is connected through solonoid actuated valve 248 to energize clutch 112.

When the solonoid actuated valves 246, 248, and 250 are de-energized, high pressure line 255 will be connected to the rod end of each of the cylinders while the base of each of the cylinders is connected to a low pressure or exhaust line 259.

Each exhaust line 257 and 259 is provided with a muffler 260 and 261.

To assure that the edge of metering member 40 is not excessively indented into resilient roller surface, a pressure regulator 245 is positioned in the line 242*a* leading to the base of cylinder 65. Regulator 245 has an adjustable output pressure and is employed for reducing pressure from high pressure line 255 which may be at, for example, 80 pounds per square inch to a control pressure of, for example, 60 pounds per square inch. This safety device or control pressure is preferably established by adjusting regulator 245 while the inker is running.

Solonoid actuated valve 244 is connected to a low pressure line 265, carrying compressed air at a pressure of, for example, 10 pounds per square inch, the pressure being regulated by a vent pressure regulator 266.

When the inker is initially energized by closing an electrical circuit to turn the unit on, solonoid actuated valve 248 will be energized for delivering pressurized air through line 248*a* to clutch 112 for engaging the clutch to enable clutch 112 to transmit torque to the applicator roller 80 when the press drive is energized.

Also when the press is started, solonoid 244 will be shifted to deliver high pressure air to double acting solonoid valve 242 for moving the metering edge on metering member 40 from a very lightly indented position to the indentation which is required for metering a film of ink onto the applicator roller. High pressure air is supplied through line 255*b* to valve 244 and low pressure air is supplied through line 265*b*. Valve 242 is shown in the energized normal running position. When valve 242 is energized to the cleaning position, pressurized fluid is delivered through the line 242*b* to lift the metering member.

When the "print on" button is pushed on the control, solonoid actuated valve 250 is immediately actuated for moving the hydrophilic roller on the dampener into engagement with the applicator roller 80 for delivering dampening fluid to applicator roller 80. Simultaneously, cylinder 205 is actuated for removing excess dampening fluid from the surface of applicator roller 80. When the "print on" circuit is closed, the signal is delivered through a time delay device for energizing solonoid actuated valve 248 after a predetermined period of time for delivering pressurized fluid to cylinders 38 for moving applicator roller 80 into engagement with the printing plate.

DAMPENING SYSTEM

The dampener 225 comprises a hydrophilic transfer roller 226 and a resilient covered metering roller 228 rotatably secured to hangers 230. Dampeners of this general configuration are well known to persons skilled in the art and further description thereof is not deemed necessary. However, such dampener is of the type disclosed in Dahlgren U.S. Pat. No. 3,343,484, dated Sept. 26, 1967, entitled "Lithographic Dampener With Skewed Metering Roller," the disclosure of which is incorporated herein by reference.

As best illustrated in FIGS. 1, 2, 17 and 17A, throw-off cylinder 300 has a lower end pivotally connected to the frame member 32' by a lug 232 and a rod pivotally connected to a bell-crank 234. Bell-crank 234 is secured by a pin 235 and angle bracket 236 to frame member 32'.

The dampening fluid metering roller 228 is provided with a night latch mechanism similar to that hereinbefore described for the vibrator rollers 102–124. As best illustrated in FIG. 17 of the drawing, latch member 194 is pivotally connected by a pin 198 to a slide bar 199 wherein is located pressure adjustment screw 197. Latch member 194 is also pivotally secured by a pin 193 to one end of a link (not shown) the other end of which is pivotally secured by a pin 196 to hangers 230. Pin 198 pivotally connects latch member 194 to a slide bar 199 which supports pressure adjustment screw 197.

As viewed in FIG. 17, latch member 194 is in the on impression position wherein slide bar 199 and pressure adjustment screw 197 are urged to the innermost position. When latch member 194 is rotated 45° in a counterclockwise direction, as viewed in FIG. 17, pin 193 will be elevated allowing movement of pin 198 and slide bar 199 outwardly for reducing pressure between the metering roller and transfer roller of the dampening system.

Having described our invention, we claim:

1. An inking system for a lithographic printing plate comprising: a frame; and applicator roller having a resilient outer surface; means rotatably securing said applicator roller to said frame; a metering member operative upon rotation of the applicator roller for forming, from an ink film of irregular thickness carried by the applicator roller, a thin film of ink of substantially a uniform thickness, said metering member having a metering edge and a trailing edge and presenting to the irregular ink film a substantially flat metering surface on the metering member adjacent the metering edge; support means urging both the metering edge and the trailing edge on the metering member to indent the resilient roller surface; means on the resilient roller surface and cooperating with the metering member to form a reservoir for ink on the resilient surface of the applicator roller; a crank arm secured to said support means; means rotatably securing said support means and said crank arm relative to said frame for rotation about a common axis; position adjustment means secured to said frame in alignment with said metering edge on said metering member; and means to move said common axis relative to said position adjustment means to adjust the angle of intersection of said metering surface relative to a plane tangent to the applicator roller surface; means applying dampening fluid to said applicator roller for dampening a lithographic printing plate; means for removing dampening fluid from the applicator roller after the printing plate has been dampened; and positive drive means to rotate the applicator roller.

2. The inking system of claim 1, said positive drive means to rotate the applicator roller comprising: a positive variable speed control device driven by a printing press; and means drivingly connecting said control device to said applicator roller to maintain a fixed speed ratio between the applicator roller and a printing plate.

3. An inking system according to claim 1, wherein said dempening means applies the dampening fluid film to the ink film for dampening a lithographic printing plate and comprises: a hydrophilic dampening fluid transfer roller; means to move said transfer roller into pressure indented relation with the resilient surface of the applicator roller; and means forming a film of dampening fluid on the hydrophilic transfer roller for application to a film of ink on the applicator roller; and control means for activating said means for removing dampening fluid from the applicator roller upon movement of said hydrophilic transfer roller into engagement with said applicator roller.

4. An inking system according to claim 1, said means on the resilient roller surface and cooperating with said metering member to form a reservoir for ink on the resilient surface of the applicator roller comprising: a pair of end dams, each of said end dams having a curved surface having a radius of curvature substantially equal to the radius of curvature of the applicator roller; means positioning the curved surface on each of said end dams in sealing relation with the outer periphery of the applicator roller; and a transversely extending member secured to each of said end dams and extending longitudinally along said applicator roller between the end dams, said end dams being urged into sealing relation with said support means for said metering member.

5. An inking system according to claim 1, said support means comprising: a rigid support bar having a ground, true face formed thereon; a clamp bar movably secured to said support bar; and locking means associated with said support bar and said clamp bar for grippingly engaging said metering member.

6. An inking system according to claim 5, with the addition of a pair of guide blocks adjacent opposite ends of said applicator roller; means securing said support bar between said guide blocks; and means movably supporting said guide blocks to permit movement of said guide blocks for changing an angle between the flat metering surface on the metering member and a line tangent to the applicator roller.

7. An inking system for a lithographic printing plate comprising: an applicator roller having a resilient outer surface; a metering member operative upon rotation of the applicator roller for forming, from an ink film of irregular thickness carried by the applicator roller, a thin film of ink of substantially a uniform thickness; means on the resilient roller surface and cooperating with the metering member to form a reservoir for ink on the resilient surface of the applicator roller; a hydrophilic dampening fluid transfer roller; means to move said dampening fluid transfer roller into pressure indented relation with the resilient surface of the applicator roller; means forming a film of dampening fluid on the hydrophilic transfer roller for application to a film of ink on the applicator roller; means for removing dampening fluid from the applicator roller after the printing plate has been dampened; control means for activating said means for removing dampening fluid from the applicator roller only upon movement of said hydrophilic transfer roller into engagement with said applicator roller; and positive drive means to rotate the applicator roller.

8. The inking system of claim 7, said applicator roller applying ink and dampening fluid to the printing plate at a nip; said means for removing dampening fluid from the applicator roller after the printing plate has been dampened being positioned to remove dampening fluid immediately adjacent said nip.

9. The inking system according to claim 7, said means for removing dampening fluid comprising: a doctor blade; a support bar having openings formed in opposite ends thereof; a pair of pistons, one of said pistons being slidably disposed in each of said openings; and means to deliver pressurized fluid into each opening to move said support bar relative to said applicator roller; and means to secure said doctor blade to said support bar.

10. The inking system according to claim 9, said means to move the transfer roller comprising at least one pressure actuated cylinder; and said means to deliver pressurized fluid being adapted to deliver pressurized fluid to said pressure actuated cylinder.

11. An inking system according to claim 7, with the addition of a rigid metering member support bar having a ground, true face formed thereon; a clamp bar movably secured to said support bar; and locking means associated with said metering member support bar and said clamp bar for grippingly engaging said metering member.

12. An inking system according to claim 11, with the addition of a pair of guide blocks adjacent opposite ends of said applicator roller; means securing said metering member support bar between said guide blocks; and means movably supporting said guide blocks to permit movement of said guide blocks for changing an angle between a flat metering surface on the metering member and a line tangent to the applicator roller.

13. An inking system according to claim 11 said locking means comprising: at least two pins movably securing said clamp bar to said metering member support bar; spring means on each pin to urge said clamp bar into gripping relation with a metering member positioned between said metering member support bar and said clamp bar; and cam means secured to said metering member support bar and engageable with said pins to compress said springs and relaese said metering member.

14. An inking system according to claim 11, said means on the resilient roller surface and cooperating with metering member to form a reservoir for ink on the resilient surface of the applicator roller comprising: a pair of end dams, each of said end dams having a curved surface having a radius of curvature substantially equal to the radius of curvature of the applicator roller; means positioning the curved surface on each of said end dams in sealing relation with the outer periphery of the applicator roller; and a transversely extending member secured to each of said end dams and extending longitudinally along said applicator roller between the end dams, said end dams being urged into sealing relation with said metering member support means.

15. A liquid metering device comprising: a frame, an applicator roller having a resilient outer surface; a metering member operative upon rotation of the applicator roller for forming, from a liquid film of irregular thickness carried by the applicator roller, a thin film of liquid of substantially a uniform thickness, said metering member having a metering edge and a trailing edge and presenting to the irregular film a substantially flat metering surface on the metering member adjacent the metering edge; support means urging both the metering edge and the trailing edge on the metering member to indent the resilient roller surface; a pair of end dams, each of said end dams having a curved surface having a radius of curvature substantially equal to the radius of curvature of the applicator roller; means pivotally securing first ends of each of said end dams to said frame; means positioning the curved surface on each of said end dams in sealing relation with the outer periphery of the applicator roller; a transversely extending member secured to a central portion of each of said end dams and extending longitudinally along said applicator roller between the end dams, said end dams being urged by force of gravity into sealing relation with said applicator roller, said support means positioning said metering edge on said metering member between second ends of said end dams and urging opposite ends of said metering member into sealing relation with said end dams.

16. A liquid metering device comprising: a frame; and applicator roller having a resilient outer surface rotatably secured to said frame means on the resilient roller surface to form a reservoir for liquid on the resilient surface of the applicator roller; a metering member operative upon rotation of the applicator roller for forming a thin film of substantially uniform thickness from liquid in the reservoir, said metering member having a metering edge and a trailing edge and presenting to liquid in the reservoir a substantially flat metering surface on the metering member adjacent the metering edge; a rigid support member having a ground, true face formed thereon; a clamp member; means movably securing said clamp member to said support member such that a surface on said clamp member is parallel to the ground, true surface on the support member; cam actuated means associated with said support member and said clamp member for moving said clamp member relative to said support member to grip said metering member between said ground, true support member and said clamp member; and means securing said support member relative to said frame to urge both the metering edge and the trailing edge on the metering member to indent the resilient roller surface.

17. A liquid metering device comprising: a frame; an applicator roller having a resilient outer surface rotatably secured to said frame means on the resilient roller surface to form a reservoir for liquid on the resilient surface of the applicator roller; a resilient metering member operative upon rotation of the applicator roller for forming a thin film of substantially uniform thickness from liquid in the reservoir, said metering member having a metering edge and a trailing edge and presenting to liquid in the reservoir a substantially flat metering surface on the metering member adjacent the metering edge; a rigid support member; a crank arm secured to said rigid support means; means rotatably securing said support means and said crank arm relative to said frame for rotation about a common axis; position adjustment means secured to said frame in alignment with said metering edge on said metering member; and means to move said common axis relative to said position adjustment means to adjust the angle of intersection of said metering surface relative to a plane tangent to the applicator roller surface.

* * * * *

UNITED STATES PATENT AND TRADEMARK OFFICE

CERTIFICATE OF CORRECTION

PATENT NO. : 4,453,463

DATED : June 12, 1984

INVENTOR(S) : Harold P. Dahlgren et al.

It is certified that error appears in the above-identified patent and that said Letters Patent is hereby corrected as shown below:

Col. 20, line 18, change "dempening" to -- dampening --

Col. 21, line 52, change "relaese" to -- release --

Col. 22, line 25, change "and" to -- an --

Col. 22, line 27, after "frame" insert -- ; --

Col. 22, line 50, after "frame" insert -- ; --

Signed and Sealed this

*Nineteenth* Day of *February 1985*

[SEAL]

*Attest:*

DONALD J. QUIGG

*Attesting Officer* *Acting Commissioner of Patents and Trademarks*